United States Patent [19]

Eure

[11] Patent Number: 4,763,362

[45] Date of Patent: Aug. 16, 1988

[54] VELCRO LATCHING DEVICE FOR A TOILET SEAT

[76] Inventor: Lee B. Eure, 101 First Street, N.W., Pulaski, Va. 24301

[21] Appl. No.: 21,698

[22] Filed: Mar. 4, 1987

[51] Int. Cl.[4] ..... A47K 13/00

[52] U.S. Cl. ..... 4/234; 4/253

[58] Field of Search ..... 4/253, 661, 234; 24/306, 31 V; 224/901; 2/DIG. 6; 297/DIG. 6

[56] References Cited

U.S. PATENT DOCUMENTS

| | | | |
|---|---|---|---|
| 619,894 | 2/1899 | Kirby, Jr. | 4/234 |
| 723,973 | 3/1903 | Alexander | 4/234 |
| 985,239 | 2/1911 | Winans | 4/241 |
| 2,877,469 | 3/1959 | Johnson | 4/241 |
| 3,395,408 | 8/1968 | Weber et al. | 4/253 |
| 3,430,299 | 3/1969 | Copen | 24/306 |
| 4,051,554 | 10/1977 | Kallman | 224/901 |
| 4,145,771 | 3/1979 | Khazin | 4/253 |
| 4,195,372 | 4/1980 | Farina | 4/234 |
| 4,342,124 | 8/1982 | Paredes | 4/234 |
| 4,407,024 | 10/1983 | Schneider | 4/234 |
| 4,438,535 | 3/1984 | Paredes | 4/234 |
| 4,451,940 | 6/1984 | Grunz | 4/234 |
| 4,477,932 | 10/1984 | Lenosky | 4/239 |
| 4,588,224 | 5/1986 | Hill, Jr. | 297/DIG. 6 |

FOREIGN PATENT DOCUMENTS

| | | | |
|---|---|---|---|
| 486612 | 7/1976 | Australia | 297/DIG. 6 |

*Primary Examiner*—Henry J. Recla
*Assistant Examiner*—Linda J. Sholl
*Attorney, Agent, or Firm*—Richard P. Matthews

[57] ABSTRACT

A Velcro latching device for a torroidal toilet seat and a toilet seat cover. In a first embodiment an elongated attaching strap has one end adhesively secured to an upper surface to a toilet seat cover and a Velcro attaching device at its free end. A Velcro patch member is adhesively secured to the lower surface of the toilet seat cover to receive the Velcro attaching device on its exposed surface. The elongated attaching strap is sufficiently long to be looped over the toilet seat so as to engage the Velcro patch member and thereby secure the toilet seat to the cover member when each are in a raised position. In the second embodiment, the elongated strap is adhesively secured to the under surface of the toilet seat cover and the Velcro patch member is adhesively secured to the upper surface of the toilet seat cover. The elongated attaching strap is sufficiently long to be looped through the opening in the torroidal toilet seat member and then over the top of the toilet seat cover member to engage the Velcro patch member thereby securing the toilet seat member to the cover member when both members are in a raised position.

3 Claims, 2 Drawing Sheets

VELCRO LATCHING DEVICE FOR A TOILET SEAT

This invention relates to means for latching a torroidal toilet seat to a toilet seat cover and, more particularly, to the use of an elongated strap member carrying Velcro attaching means secured to a Velcro receiving member for effecting the desired latching. Velcro is a trademark of Velcro, Inc., of Manchester, N.H., for separable fasteners, namely, hook and loop type fasteners.

BACKGROUND OF THE INVENTION

Heretofore it has been known to attach the toilet seat cover to the toilet seat and thereby provide more sanitary conditions while urinating into the toilet. There are also reported cases in which the toilet seat falls on small children's penises while they are urinating resulting in trauma. By attaching the toilet seat to the toilet seat cover, the risk of this occurring would be minimized.

Some of the devices which have been used heretofore have required permanent alteration of the toilet seat and/or the toilet seat cover. This is generally objectionable both from an appearance standpoint and from a sanitary standpoint, and has resulted in the failure of these devices to be adopted. Some other devices automatically lift the toilet seat to a raised position. These latter devices frequently employ a mechanical spring device. These automatic lifting devices have also not been generally accepted principally because most people prefer to have the toilet seat and toilet seat cover in a lowered or closed position.

SUMMARY OF THE INVENTION

In accordance with the present invention, the undesirable features of the known prior art devices have been eliminated. A manually operated latching means is provided for torroidal toilet seat members which are customarily found in residential homes with the toilet seat being secured to the toilet seat cover when both the seat and the cover are in the raised position. This provides a sanitary condition in that the seat member will not be contaminated from a person's urination from a standing position. Also the securing of the toilet seat to the toilet seat cover virtually precludes the premature falling of the toilet seat. After urination is completed the Velcro attaching members may be separated and the toilet seat and the toilet seat cover lowered to their closed position.

In one embodiment of the present invention, an elongated attaching strap has one terminal end thereof, adhesively secured to the upper surface of the toilet seat cover. The elongated attaching strap has its other terminal end provided with Velcro attaching means on the same side of the strap as the adhesively secured side. A Velcro patch member is adhesively secured to the lower surface of the toilet seat cover member at a location within the opening of the torroidal toilet seat. The exposed side of the Velcro patch member is provided with Velcro latch receiving means on the Velcro patch member with the Velcro attaching means thereby securing the toilet seat member to the toilet seat cover member when the members are in a raised position.

In another embodiment of the present invention, the elongated strap is adhesively secured to the under surface of the toilet seat cover and the Velcro patch member is adhesively secured to the upper surface of the toilet seat cover. The elongated strap is sufficiently long to be looped through the opening in the torroidal toilet seat member and then over the top of the toilet seat cover member to engage the Velcro patch member and thus secure the toilet seat member to the cover member when both members are in a raised position.

In each embodiment the securement of the toilet seat member to the toilet seat cover member provides an improved sanitary condition which permits urinating into the toilet from a standing position without contaminating the toilet seat. The Velcro members also provide a quick release whereby the toilet seat member and toilet seat cover member may each be lowered into a closed position. If necessary, in the second embodiment, the elongated attaching strap member is provided with Velcro latch receiving means on an exposed surface directly oppostie its adhesively secured terminal end so that the elongated strap may be bent in half to engage this Velcro attaching mean at its other end to the Velcro latch receiving means to effect a stored position for the strap member out of contact with water in the bowl of the toilet.

The inherent advantages and improvements of the present invention will become more readily apparent by reference to the following detailed description of the invention and by reference to the drawings wherein.

DETAILED DESCRIPTION OF THE INVENTION

Figure 1:
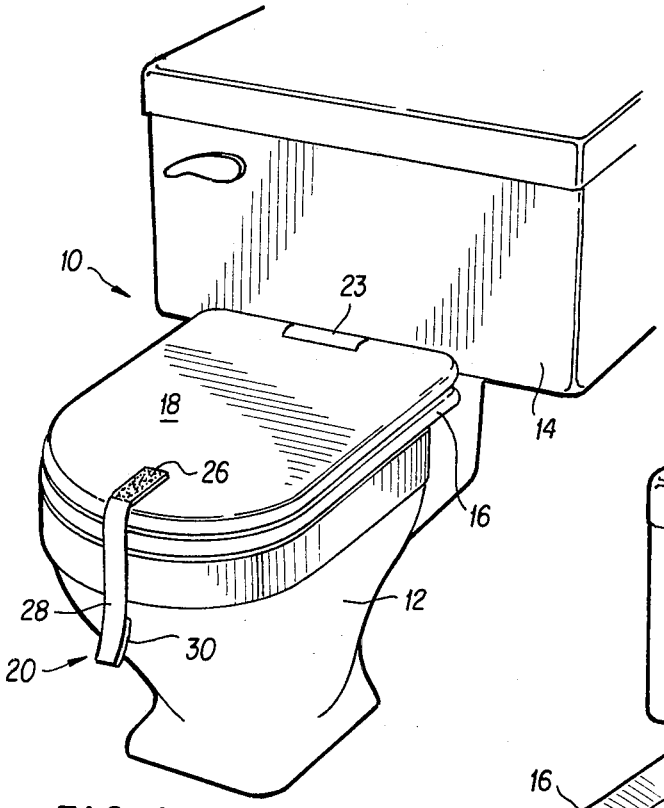
FIG. 1 is a fragmentary perspective view illustrating a Velcro latch for a toilet seat with the toilet seat cover in a down position.
Figure 2:
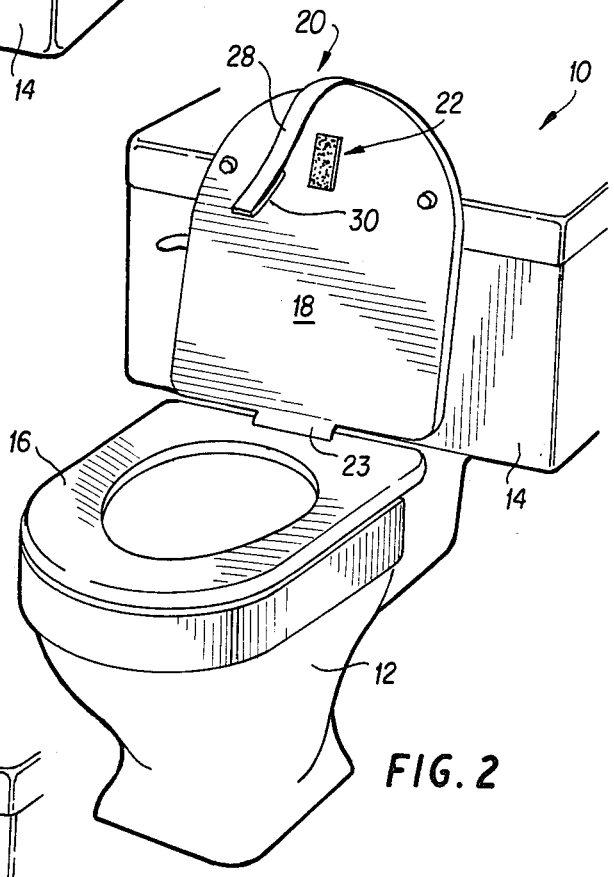
FIG. 2 is a fragmentary perspective view similar to FIG. 1 with the toilet seat cover in an up position.
Figure 3:
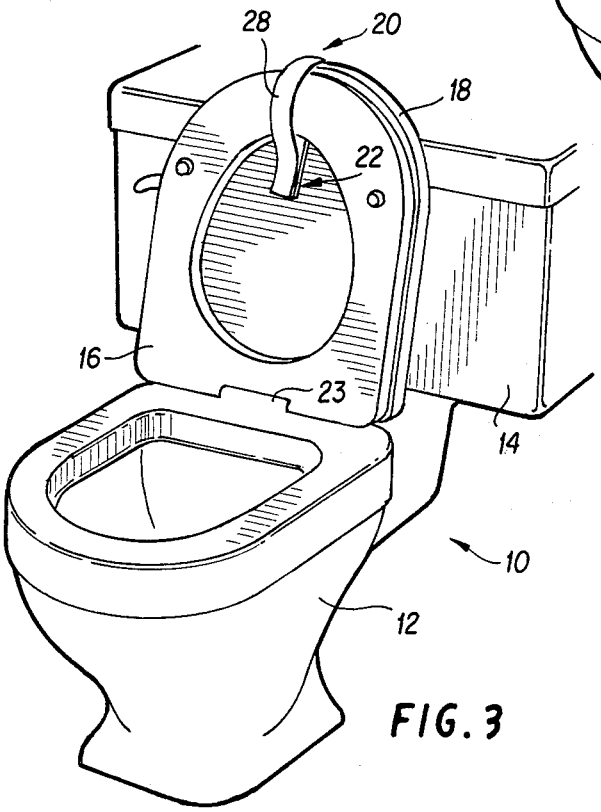
FIG. 3 is a fragmentary perspective view similar to FIG. 1 with the toilet seat cover and the toilet seat in an up and latched position.

Referring now to FIG. 1 of the drawings, there is illustrated a toilet indicated generally at 10. Toilet 10 is provided with a conventional toilet bowl 12 and water closet 14. A toilet seat member 16 rests atop the lip of toilet bowl 12 when the toilet seat member is in its lowered position and a toilet seat cover member is shown at 18. The toilet seat member 16 is torroidal in shape as is shown in FIGS. 2 and 3.

An elongated strap member is indicated generally at 20. This elongated strap member 20 cooperates with a Velcro patch member indicated generally at 22 in FIGS. 2 and 3 in order to secure or attach the toilet seat member 16 to the toilet seat cover member 18 when they are in the raised position, as is shown in FIG. 3.

Figure 4:
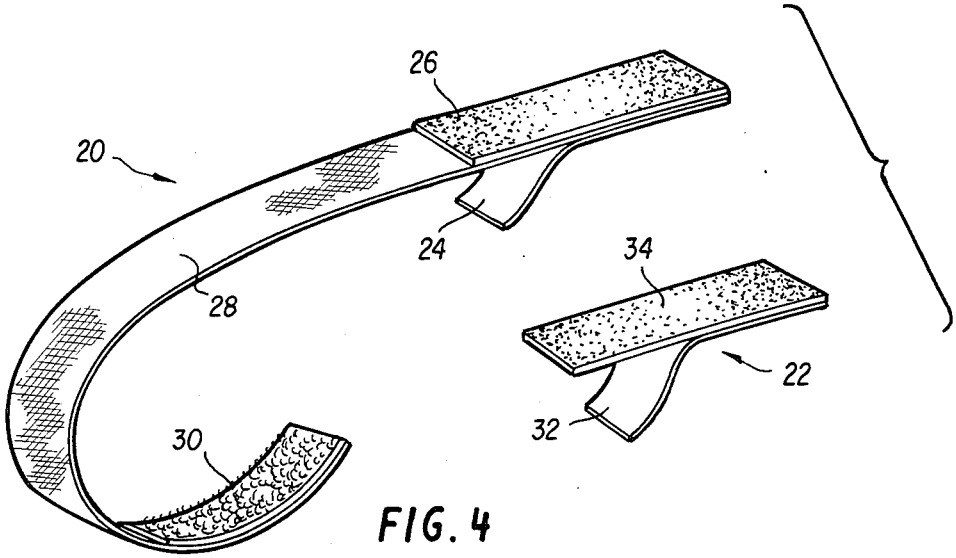
FIG. 4 is a perspective view of the Velcro latching means drawn to an enlarged scale.

Reference to FIG. 4 shows that the elongated strap member 20 is provided with a peel off paper 24 which covers an adhesive backing by means of which the elongated strap 20 may be attached where desired. Directly opposite the adhesive backing is a cloth part of a Velcro attachment 26 which is also designated as a Velcro latch receiving means. The strap 20 has a central portion 28 and a remote or free terminal end which is provided with a hook part of a Velcro attachment or Velcro attaching means 30 located on the same side of the strap as the adhesive backing.

The elongated strap 20 is shown in FIG. 1 to be adhesively secured to the upper surface of the toilet seat cover member 18 at a position near the front portion thereof so that the central strap portion 28 overhangs the front of toilet bowl 12. The Velcro patch member 22 similarly has a peel-off paper 32 to cover an adhesive backing whereby the Velcro patch member may be adhesively secured to the lower surface of the toilet seat cover member 18 at a location within the opening of the torroidal toilet seat member 16. This permits the Velcro attaching means 30 on the elongated strap 20 to be easily secured to the Velcro patch member 22 when both the toilet seat member 16 and the toilet seat cover member 18 are in the raised position as is clearly shown in FIG. 3. Not only does this provide a more sanitary condition, permitting urination into the toilet bowl 12 from a standing position without contaminating the top of toilet seat 16 but it also substantially eliminates the possibility that the toilet seat member 16 will inadvertently fall to its lowered position which, as has already been noted, could have adverse results on the person urinating into toilet bowl 12. The pivot axis for the toilet seat member and cover member is shown at 23, and is completely conventional insofar as the present invention is concerned. The toilet seat cover member 18, in its raised position, is leaned against the water closet 14. By joining the toilet member 16 and toilet seat cover member 18 together by members 20 and 22, the center of gravity for the latched members moves slightly rearwardly, thereby tending to avoid the inadvertent falling of the toilet seat member 16.

Figure 5:
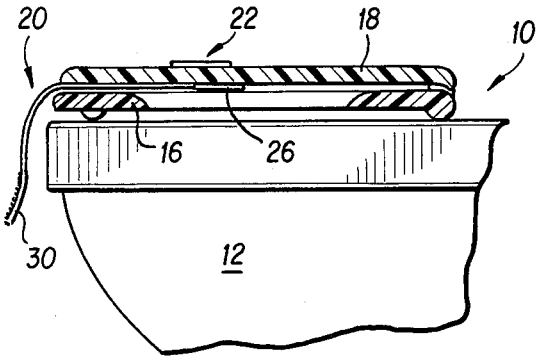
FIG. 5 is a fragmentary elevational view, taken partially in vertical cross section, illustrating an alternate positioning of the Velcro latching members with the toilet seat cover and the toilet seat in a down position.
Figure 7:
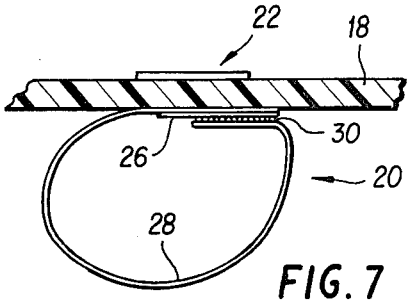
FIG. 7 is a fragmentary elevational view of the toilet seat cover shown in vertical cross section and illustrating a stored position of a Velcro latching member.
Figure 6:
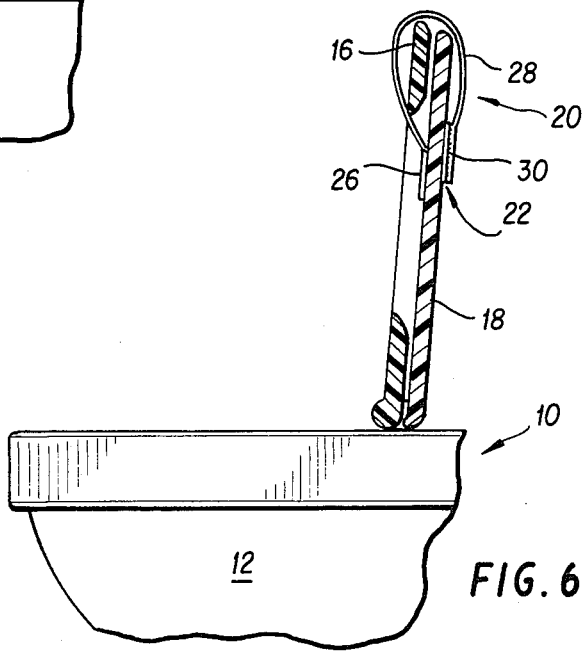
FIG. 6 is a fragmentary elevational view similar to FIG. 5 but illustrating the toilet seat cover and the toilet seat in an up position.

In the second embodiment of the invention illustrated in FIGS. 5–7, the same elongated strap member 20 and Velcro patch member 22 are employed. However, in this form of the invention, the elongated strap member 20 is adhesively secured to the underside of the toilet seat cover member 18 in a position as illustrated in FIG. 5, with the free end of the elongated strap 20 which contains Velcro attaching means 30 hanging over the front edge of toilet bowl 12. The Velcro latch receiving means 26 is positioned within the opening of the torroidal toilet seat member 16 as is illustrated in FIG. 5. In order to secure the toilet seat member 16 and the toilet seat cover member 18 together, the elongated strap is made of a sufficient length so as to be looped through the opening in the torroidal seat member 16 and then over the top of the toilet seat member and the toilet seat cover member to engage the Velcro latch receiving means 22 which in this instance is placed on the upper surface of the toilet seat cover member. This latched position is illustrated in FIG. 6 with the toilet seat member 16 and toilet seat cover member 18 in their raised position. To ensure that the elongated strap member 20 does not dip into the water in the toilet bowl 12, a stored position is provided in that the elongated attaching strap member is bent in half and the Velcro attaching means 30 is secured to the Velcro latch receiving means 26 on the elongated strap member directly opposite the adhesive securement to toilet seat cover member 18. This secured or stored position is illustrated in FIG. 7.

For purposes of illustration and without limitation, satisfactory sizes for the attaching members include a length of eleven and one half inches and width of one inch for the elongated strap member 20 and a length of three inches and width of one inch for the Velcro patch member 22. The Velcro latch receiving means 26 may be three inches in length by one inch in width, and the Velcro attaching means 30 may be two inches in length by one inch in width. These sizes are presented for illustration only and could be modified to accommodate different styles of toilets.

While presently preferred embodiments of the invention have been illustrated and described, it will be recognized that the invention may be otherwise variously embodied and practiced within the scope of the claims which follow.

I claim:

1. In a Velcro latching device for a toilet having a water closet, a torroidal toilet seat member and a toilet seat cover member having upper and lower surfaces with each member pivoting about the same axis, the combination which comprises:

a. an elongated attaching strap having one end thereof adhesively secured to the upper surface of said toilet seat cover,
   (1) said elongated attaching strap having Velcro attaching means at its other end,
b. a Velcro patch member being adhesively secured to the lower surface of said toilet seat cover member at a location within the opening of said torroidal toilet seat member,
   (1) said Velcro patch member having a Velcro latch receiving means on its exposed surface,
c. said elongated attaching strap and said Velcro patch member lying in a plane which is substantially perpendicular to the water closet of the toilet and which bisects said toilet seat member and said toilet seat cover member,
d. and said elongated attaching strap being of sufficient length to be looped over said torroidal toilet seat member and engage said Velcro latch receiving means on said Velcro patch member with said Velcro attaching means, thereby securing said toilet seat member to said toilet seat cover member when said members are in a raised position.

2. In a Velcro latching device for a toilet having a water closet, a torroidal toilet seat member and a toilet seat cover member having upper and lower surfaces with each member pivoting about the same axis, the combination which comprises a. an elongated strap having one end thereof adhesively secured to the under surface of said toilet seat cover,
   (1) said elongated attaching strap having Velcro attaching means at its other end,
b. a Velcro patch member being adhesively secured to the upper surface of said toilet seat cover,
   (1) said Velcro patch member having a Velcro latch receiving means on its exposed surface,
c. said elongated attaching strap and said Velcro patch member lying in a plane which is substantially perpendicular to the water closet of the toilet and which bisects said toilet seat member and said toilet seat cover member,
d. and said elongated attaching strap being of sufficient length to be looped through the opening in said torroidal toilet seat member and then over the top of said toilet seat cover member to engage said Velcro latch receiving means on said Velcro patch member thereby securing said toilet seat member to said toilet seat cover member when said members are in a raised position.

3. In a Velcro latching device for a torroidal toilet seat member and a toilet seat cover member as defined in claim 2 wherein said elongated attaching strap member is provided with Velcro latch receiving means on an exposed surface directly opposite the adhesively secured end and said elongated strap is bent in half to engage said Velcro attaching means at its other end to said Velcro latch receiving means to effect a stored position for said strap member out of contact with water in the toilet.

* * * * *